United States Patent [19]

Quin, deceased

[11] Patent Number: 4,500,796

[45] Date of Patent: Feb. 19, 1985

[54] SYSTEM AND METHOD OF ELECTRICALLY INTERCONNECTING MULTIPLE LIGHTING FIXTURES

[75] Inventor: Murray L. Quin, deceased, late of Tupelo, Miss., by Dorothy L. Quin, administratrix

[73] Assignee: Emerson Electric Co., St. Louis, Mo.

[21] Appl. No.: 494,257

[22] Filed: May 13, 1983

[51] Int. Cl.[3] ..... H05B 37/00

[52] U.S. Cl. ..... 307/147; 307/157; 339/29 R

[58] Field of Search ..... 307/39, 29, 140, 147, 307/157; 339/28, 29 R

[56] References Cited

U.S. PATENT DOCUMENTS

| | | | |
|---|---|---|---|
| 3,377,488 | 4/1968 | Lorenzo | 307/157 |
| 4,001,571 | 1/1977 | Martin | 315/189 |
| 4,134,045 | 1/1979 | Quin | 315/324 |
| 4,146,287 | 3/1979 | Jonsson | 339/29 R X |
| 4,272,689 | 6/1981 | Crosby et al. | 307/147 |
| 4,367,417 | 1/1983 | Casasanta | 307/147 |
| 4,399,371 | 8/1983 | Ziff et al. | 307/147 |

OTHER PUBLICATIONS

Electro Connect Catalog Pages; Day-Brite Lighting Div., Emerson Ele. Co.; 26 pages; © Jul. 1980.

Reloc Catalog Pages; Lithonia Lighting; 9 pages, May 1978.

*Primary Examiner*—Reinhard J. Eisenzopf

*Assistant Examiner*—Derek Jennings

*Attorney, Agent, or Firm*—Polster, Polster and Lucchesi

[57] ABSTRACT

A system and method of electrically interconnecting a multiplicity of electrical lighting fixtures is disclosed in which up to three phase AC power and up to five conductors (i.e., one conductor for each phase, a ground conductor, and a neutral conductor) is used in such manner that selected groups or branches of the lighting fixtures may be independently, selectively controlled, and such that wiring to the fixtures and control switches may be readily plugged into place.

19 Claims, 25 Drawing Figures

FIG. 5.
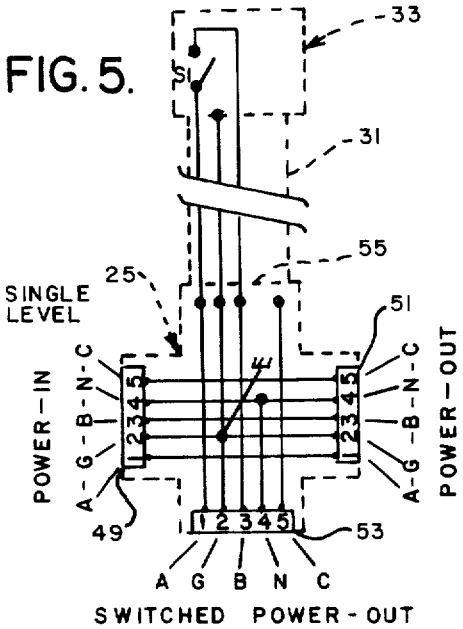
FIG. 6.
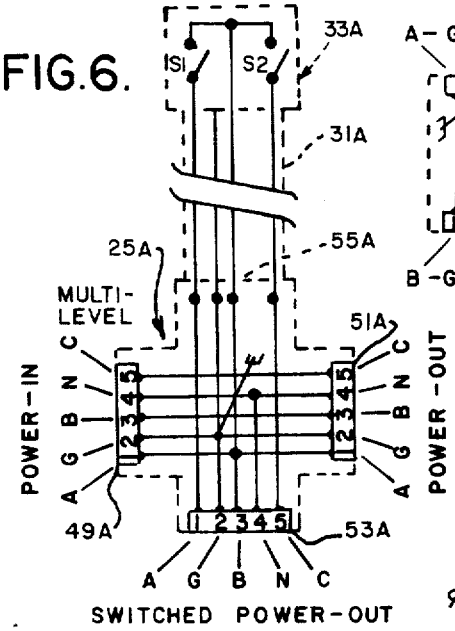
FIG. 9.
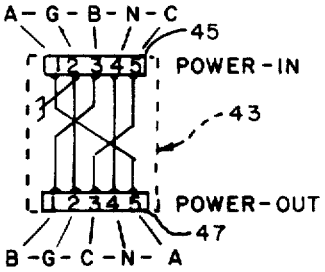
FIG. 7.
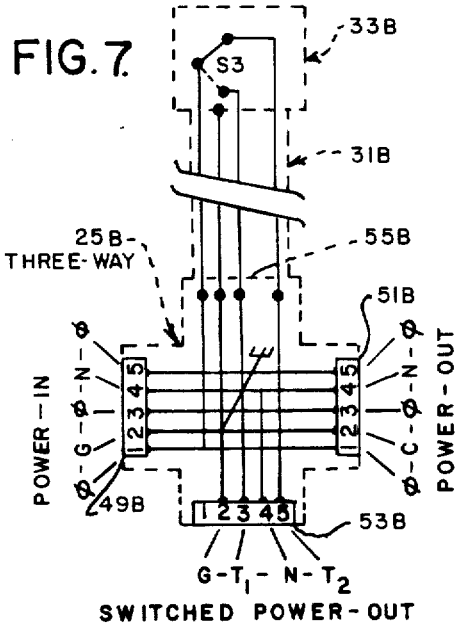
FIG. 8.
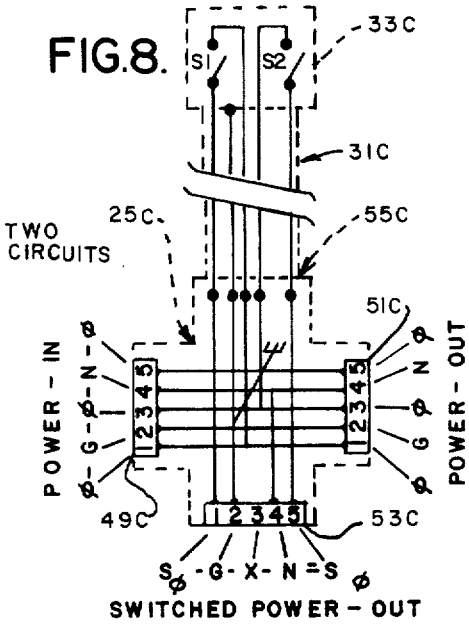
FIG. 10.
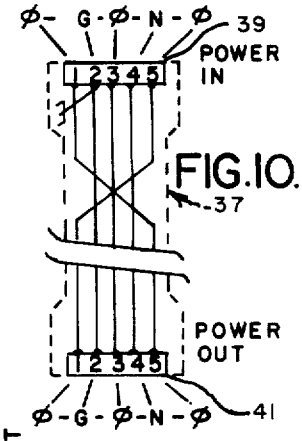
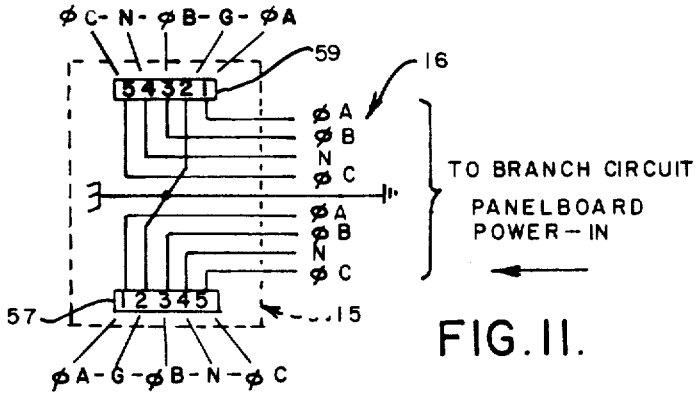
FIG. 11.

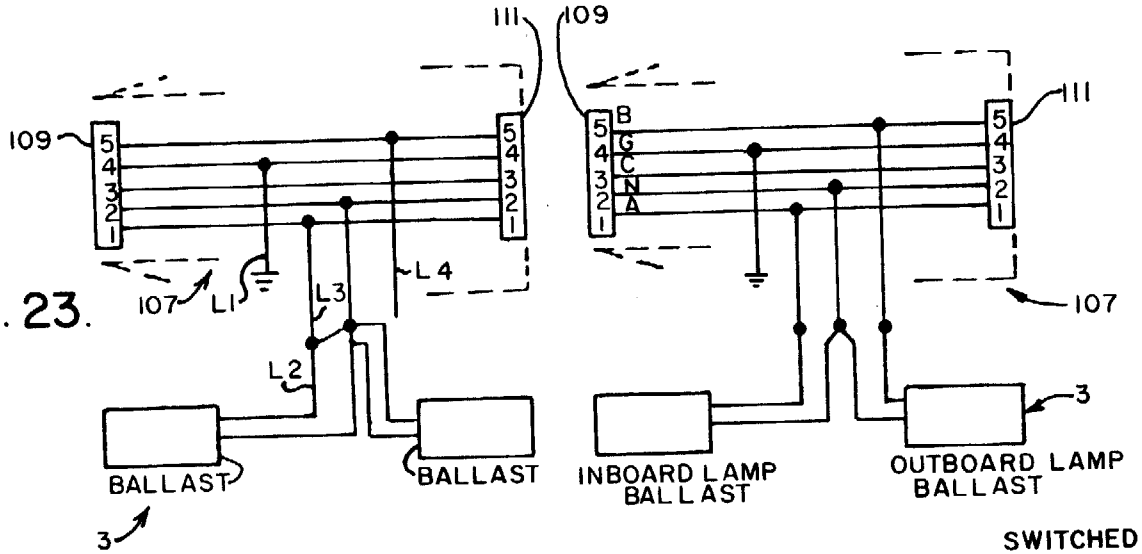
FIG. 23.
FIG. 24.
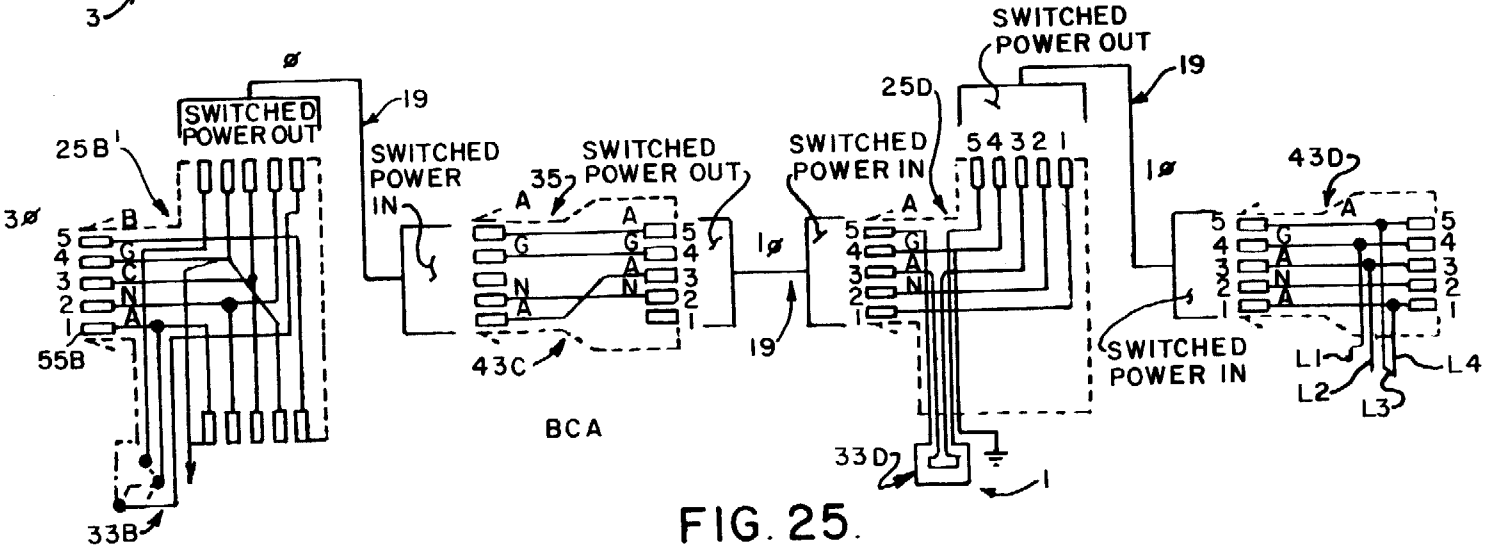
FIG. 25.

SYSTEM AND METHOD OF ELECTRICALLY INTERCONNECTING MULTIPLE LIGHTING FIXTURES

BACKGROUND OF THE INVENTION

This invention relates to a system or apparatus for and to a method of electrically interconnecting a multiplicity of lighting fixtures (or other electrical appliances) using three-phase alternating current (AC) power and using five conductors, that is, one conductor for each phase, a ground conductor, and a neutral conductor.

In recent years, modern office and other commercial buildings have become common which utilize a suspended ceiling having a grid or matrix framework suspended from the overhead ceiling/floor structure of the building with the grid framework supporting removable ceiling panels. The grid framework is typically constructed so that at desired locations, one or more of the ceiling panels may be omitted and a fluorescent lighting fixture may be fitted into the framework in place of the ceiling panels. For example, the grid framework may form two foot (60.9 cm.) squares for receiving the removable ceiling panels. A typical lighting fixture may be two feet by four feet and the lighting fixtures may be arranged in the ceiling framework in rows with one or two ceiling panels between the ends of adjacent lighting fixtures of the same row and with one or two ceiling panels between each row of the lighting fixture.

Oftentimes, in a new office building, it is conventional to install the ceiling panels and lighting fixtures before any interior partitions forming the suites of offices have been erected. Then, when the building is leased or when the desired floor plan is chosen, interior partitions are then erected by securing the partitions to the floor. Oftentimes, the partitions are not secured to the suspended ceiling. In the past, the lighting fixtures were "hardwired" by electricians requiring considerable skill and labor. For example, the lighting fixtures for one suite of offices would be connected on one or more separate control switches and the lighting fixtures for an adjacent suite of offices would be connected on a separate control switch. If it became necessary to rewire the lighting fixtures, because, for example, of a change in floor plan, it would be necessary for an electrician to rewire the lighting fixtures.

Recognizing these problems, various plug/in electrical wiring systems became commercially available. One such system is shown in U.S. Pat. No. 4,001,571 to Martin. While the system shown in Martin worked well for its intended purpose, this system utilized single phase AC electrical power and required the crossing of the two leads so as to switch the connection of the lamps from one circuit to the other through the use of so-called converter adapters. This required the use of stacked plug/in connectors, and in certain instances, up to five such connectors must be stacked. Thus, a great many electrical parts were required for utilizing this system and the possibility of poor electrical connections within the stacked connectors was increased.

In the inventor's coassigned U.S. Pat. No. 4,134,045, many of the problems with prior electrical interconnect systems were overcome by employing convenient, interchangeable, rotating connectors or by employing connector cables in which two leads were crossed. The electrical interconnect system shown in the above-mentioned U.S. Pat. No. 4,134,045 provided a system in which interchangeable connections were provided for successive fixtures in one or the other of the circuits formed by three continuous wire leads. Electrical components constructed in accordance with the above-noted U.S. Pat. No. 4,134,045 are commercially available from the Day-Brite Lighting Division, Emerson Electric Co., Tupelo, Miss. under the trademark ELECTRO/CONNECT.

In general terms, the wiring system disclosed in the above-mentioned U.S. Pat. No. 4,134,045 and commercially available under the trademark ELECTRO/CONNECT system, utilizes four main components. First, a so-called distribution interface which is connected to a panel board by conventional conduit and wire. The distribution interface includes a number of receptacle power circuits to which prewired receptacle power cables may be plugged into. The power cables may lead to branches of lighting fixtures or to wall mounted utility plugs. When it is desired to selectively switch groups or branches of the lighting fixtures independently of others of the lighting fixtures, a so-called switching cable assembly is plugged into a common receptacle provided on each of the lighting fixtures. The switching cable assembly includes a power in receptacle into which an end from one of the flexible power cables is inserted to bring power to that lighting fixture. One or both of the "hot" conductors in the switching cable assembly may be selectively opened and closed by single pole, single throw (SPST) wall mounted switch. Each of the lighting fixtures typically includes a fixture adapter which receives the switched power from the switching cable assembly and into which a flexible jumper cable can be plugged so that the switched power may energize not only the lighting fixture into which the switching cable assembly is plugged, but also may control the energization of a series of lighting fixtures energized by the jumper cable assemblies connected to the fixture adapter of the one fixture. Further, the switching cable assembly includes a power-out receptacle which transfers electrical power through the switching cable assembly in the same manner in which the power was received. Thus, the power may be continued to other branches within the office suite.

Additionally, between the switching cable assembly and the next group of lighting fixtures powered by the circuit, it is necessary to provide either a crossover cable or a so-called rotating coupler in which the pin positions of the "hot" conductors in the plug is reversed or crossed. In this manner, identical switching cable assemblies and remote switches may be utilized thus greatly simplifying the number of components required for this system and greatly simplifying the instructions for installation.

This commercially available ELECTRO/CONNECT plug-in wiring system has met with considerable commercial success because it requires only four standardized, basic components which are prewired and which snaplock together without even the use of simple handtools. Moreover, these components are reuseable so that in the event the floor plan for the office is changed, the same components may be readily unplugged from one circuit and replugged into another circuit as required.

However, as can be appreciated, the number of lighting fixtures that can be powered or energized by one main circuit is limited to the current draw of the lighting fixtures. For example, if power is supplied from a panelboard having 20 amp, 120 volt circuit breakers installed therein, only approximately 15 lighting fixtures may be energized by that circuit if each lighting fixture has four 40 watt fluorescent lamps.

It had been previously recognized that, in commercial buildings, three phase power is often available. By utilizing three phase power to energize the lighting fixtures, it was recognized that the number of distribution interface panels required to energize the lighting fixture could be significantly reduced. However, because of the increased number of conductors available, the complexity of and the number of components required for a three phase, five conductor wiring system was greater than the system illustrated in the above-mentioned U.S. Pat. No. 4,134,045. Thus, there has been a longstanding need for a five conductor, three phase flexible plug-in wiring system which is less complex than prior systems.

BRIEF DESCRIPTION OF THE INVENTION

Among the several objects and features of the present invention may be noted the provision of an electrical interconnect system and method for multiple lighting fixtures (or other electrical applications) in which branch circuits are more easily grouped at panelboards and in which the loads are better balanced than with prior art electrical distribution systems;

The provision of such an interconnect system which optimizes the number of cables thus requiring less materials;

The provision of such an interconnect system which permits multi-level switching downstream from a first multi-level switch point;

The provision of such an interconnecting electrical system in which standardized crossover cables or rotating couplers of a standard design may be utilized at any point within a circuit of the present invention;

The provision of such an interconnecting electrical system which has the capability of handling three separate phases in branch runs;

The provision of such an electrical interconnect system having the capability of handling three parallel legs of the same phase in a fixture branch run, two of which legs can be multi-level switched at an upstream point and one unswitched leg for multi-level switching at downstream points;

The provision of such an electrical interconnect system in which the number of cable types and other components are minimized thereby to reduce inventory requirements and to reduce the number of components required in the field for utilization of the system;

The provision of such an electrical interconnect system in which the instructions for installation and use are simple such that workmen may readily utilize the system without the requirement of specialized training and without the requirement of even simple handtools; and The provision of such an electrical interconnect system which is simple to use, which is quickly installed, which is reliable in operation, and which is reuseable.

Briefly stated, an electrical interconnect system for multiple lighting fixtures is disclosed comprising a source of three phase alternating current electrical power, and a plurality of lighting fixtures. A first switching cable assembly is provided between the power source and successive lighting fixtures, and a plurality of power cables, each cable having a first (A), a second (G), a third (B), a fourth (N), and a fifth (C) lead, with one of the power cables extending from the power source to the first switching cable assembly. (These reference characters refer to the drawings of the instant specification.) The first switching cable assembly has internal circuit connections for connecting a first series of lighting fixtures to the first (A), second (G), and fourth (N) leads with the fixtures of the first series cf fixtures being energized by a first phase of the three phase electrical power. A first switch is connected to the first switching cable assembly for selectively energizing and de-energizing the first series of lighting fixtures. A second switching cable assembly is electrically connected to the first switching cable assembly via the power cables. Means is provided between the first and second switching cable assemblies for cross-connecting the leads of the power cable from the first switching cable assembly to the cross-connecting means with other leads in the power cable from the cross-connecting means to the second switching cable assembly such that the first lead (A) from the first switching cable assembly becomes the fifth lead to the second switching cable assembly, the third lead (B) from the first switching cable assembly becomes the first lead to the second switching cable assembly, and the fifth (C) lead from the first switching cable assembly becomes the third lead to the second switching cable assembly. The second switching cable assembly has internal circuit connections for connecting a second series of lighting fixtures to the third (B), second (G) and fourth (C) leads relative to the first switching cable assembly with the lighting fixtures of the second series of lighting fixtures being energized by a second phase of the three phase electrical power. A second switch is connected to the second switching cable assembly with the first switch being operable to control energization and de-energization of the first series of fixtures without interference with the operation of the second series of lighting fixtures and with the second switch being operable to control energization and de-energization of the second series of lighting fixtures without interference with the operation of the first series of lighting fixtures.

The method of this invention of interconnecting a plurality of lighting fixtures into one or more series of successive fixtures with the fixtures being energized by means of three phase alternating current electrical power utilizes five lead power cables with each of the series of fixtures being selectively energizable and de-energizable with respect to and independently of one another. More specifically, the method comprises the steps of extending a first power cable having a first (A), a second (G), a third (B), a fourth (N), and a fifth (C) lead therein from a source of three phase alternating current electrical power. The first power lead is connected to a first switching cable assembly. A first circuit is branched from the first switching cable assembly for energizing a first series of lighting fixtures with the first series of lighting fixtures being energized by a first phase of power using the first (A), second (G), and fourth (N) leads. A remotely operable first switch is connected to the first switching cable assembly for selectively controlling energization and de-energization of the first series of lighting fixtures. The three phase power continues from the first switching cable assembly to a second switching cable assembly with the leads exiting the first switching cable assembly being in the same order (i.e., A, G, B, N, C) as the leads entering the first switching cable assembly. The leads between the first and second switching cable assemblies are cross connected such that the first lead (A) from the first switching cable assembly becomes the fifth lead to the second switching cable assembly, the third lead (B) from the first switching cable assembly becomes the first lead to the second switching cable assembly, and such that the fifth lead (C) from the first switching cable assembly becomes the third lead to the second switching cable assembly. A second circuit is branched from the second switching cable assembly for energizing a second series of fixtures by a second phase of the three phase electrical power using the third, second, and fourth leads relative to the first switching cable assembly. A remotely operable second switch is connected to the second switching cable assembly for selectively controlling energization and de-energization of the second series of fixtures.

Other objects and features of this invention will be in part apparent and in part pointed out hereinafter.

BRIEF DESCRIPTION OF THE DRAWINGS

FIG. 5 is a schematic view of a switching cable assembly (SCA) in which on remotely located single pole single throw (SPST) wall switch is utilized for single level switching;

FIG. 6 is a schematic view of an switching cable assembly similar to that shown in FIG. 5 in which a pair of SPST wall switches are utilized for multi-level switching;

FIG. 7 is a schematic view of an switching cable assembly generally similar to FIGS. 5 and 6 in which a single pole, double throw (SPDT) wall switch is utilized for three way switching;

FIG. 8 is a schematic view of an switching cable assembly generally similar to FIGS. 5–7 in which a pair of SPST wall switches are utilized for two circuit switching;

FIG. 9 is a schematic view of the internal wiring of a rotating coupler or cross over of the present invention for three phase power;

FIG. 10 is a schematic view of a crossover cable of the present invention;

FIG. 11 is a schematic view of a distribution interface junction of the present invention;

FIG. 23 is a schematic of how a multiple ballast lighting fixture is wired to the interconnection system of the present invention for single level switching of the lamp (i.e., all of the lamps in the fixture are simultaneously energized or de-energized);

FIG. 24 is a schematic similar to FIG. 23 wherein the ballasts of the lighting fixture are wired for multi-level switching of the lamps (i.e., some of the lamps in the fixture may be energized and de-energized independently of the other lamps) for selectively changing lighting intensities; and FIG. 25 is a schematic of a number of the components of the interconnection system of the present invention as they are installed in a branch run as, for example, shown in branch run BCA of FIG. 3 in which the lighting fixtures are energized by single phase power.

Corresponding reference characters indicate corresponding parts throughout the several views of the drawings.

DESCRIPTION OF PREFERRED EMBODIMENTS

Figure 1:
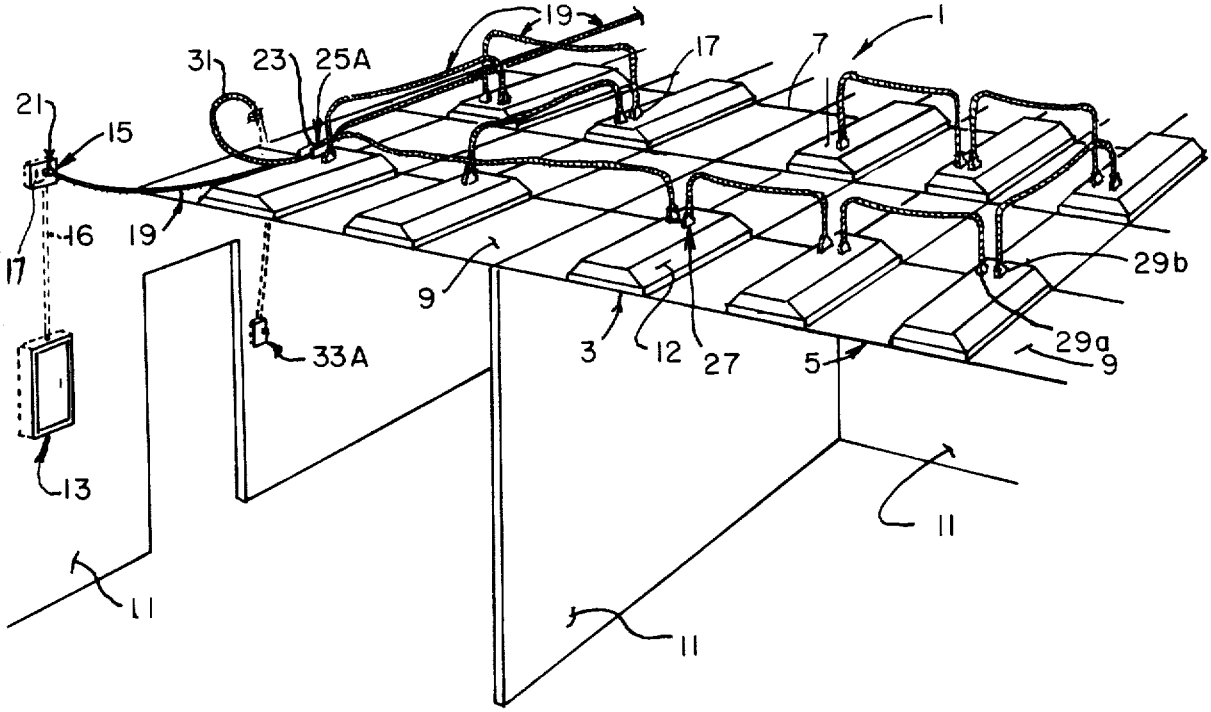
FIG. 1 is a perspective, semi-diagrammatic view of a typical suspended ceiling in an office building or the like, the ceiling having a multiplicity of fluorescent lighting fixtures installed therein with the lighting fixtures being electrically connected to a source of three-phase electrical power by the electrical interconnection system of this invention and with groups or branches of the lighting fixtures being selectively energizable by wall switches in accordance with the system and method of this invention.

Referring now to the drawings, and particularly to FIG. 1, the electrical interconnect system of the present invention, indicated in its entirety by reference character 1, for electrically interconnecting a multiplicity of fluorescent lighting fixtures 3 is illustrated with the lighting fixtures being supported by a suspended ceiling 5. More specifically, the suspended ceiling includes a ceiling framework 7 having a grid-like frame adapted to support removable, liftout ceiling panels 9. For example, ceiling framework 7 may be constructed so that the ceiling panels 9 are square panels approximately two feet by two feet (60.9×60.9 cm) and the framework is suspended from a roof or ceiling framework (not shown) above the suspended ceiling by means of hangers or the like (also not shown) in a manner well known to those skilled in the art. Typically, the suspended ceiling 5 is separated from the overhead support ceiling or floor structure by a distance of several inches to several feet thereby to accommodate the running of electrical wiring, heating, air conditioning and ventilating ducts, plumbing, and the like. Generally, the removable ceiling panels 9 may be lifted upwardly clear of framework 7, rotated, and removed from the framework.

Rooms are defined within the building of walls by partitions, as generally indicated at 11. Oftentimes, in a modern office building or the like, partitions 11 may be formed by metal studs secured to a floor plate which in turn is rigidly fastened to the floor. The metal studs are typically faced with drywall sheathing, but the partitions are not fastened to the suspended ceiling 5, even though the ceiling framework may bear against the top of the partitions. Such construction allows the building owner or tenants a great deal of flexibility in arranging floor plans for suites of offices within the building as the partitions 11 may be positioned at any desired location within the building. Upon rearranging the floor plan, partitions 11 may be readily removed and replaced with other partitions.

Conventionally, large commercial buildings, such as office buildings, having suspended ceilings 5 and partitions 11, as above described, have a plurality of fluorescent lighting fixtures 3 arranged in parallel rows (or in other arrangements) within the suspended ceiling. A lighting fixture 3 may have a sheetmetal frame 12 which is adapted to fit within one or two of the spaces of the ceiling framework 7 normally occupied by one or more removable ceiling panels 9. The bottom face of the lighting fixture including the luminaire lens (not shown) is generally flush with the lower surface of the ceiling panels. For example, lighting fixtures 3 comprising a row of lighting fixtures may be two feet by four feet (60.9×121.8 cm.) and may have one ceiling panel 9 between the ends of adjacent lighting fixtures in the same row and may have two ceiling panels 9 between lighting fixtures of adjacent rows. It is a common construction practice to install lighting fixtures 3 in suspended ceiling 5 at the time the building is under construction, prior to the erection of partitions 11.

Electrical interconnect system 1 of the present invention comprises a panelboard, as generally indicated at 13, to which three phase, alternating current (AC) power is supplied by means of a suitable service line (not shown). A distribution interface panel, as generally indicated at 15, is supplied with three phase electrical power from panelboard 13 by means of a conduit-protected conductor 16. Oftentimes, distribution interface panel 15 is mounted on a permanent structure of the building, such as on a permanent wall or ceiling member, as opposed to being mounted on a removable partition 11. The interface panel 15 includes a so-called interface receptacle 17 into which may be plugged one or more lighting cable assemblies, as generally indicated at 19.

Figure 13:
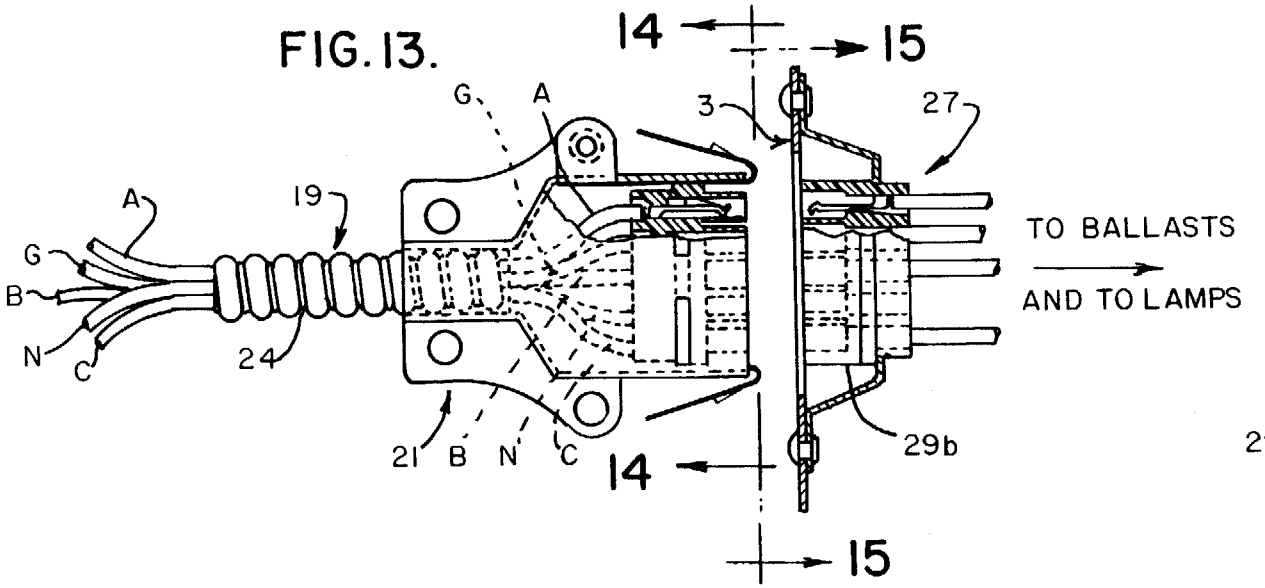
FIG. 13 is an enlarged view of a one plug-in connector of the cable shown in FIG. 12 and of a portion of a lighting fixture with portions of the connector broken away and illustrating a portion of an adapter receptacle installed in the lighting fixture.
Figure 12:
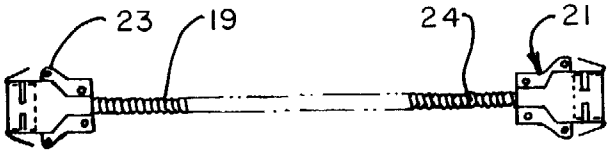
FIG. 12 is a view of a typical lighting cable of the present invention having plug-in connectors on its ends.

More specifically, as best shown in FIGS. 12 and 13, each lighting cable assembly 19 includes one "hot" conductor for each of the three phases of the three phase electrical AC power with these "hot" conductors being indicated at A, B, and C for the first, second, and third phases of the three phase power, respectively. Further, the lighting cable assembly includes a ground conductor G and a neutral conductor N such that the cable assembly 19 includes five conductors. A male plug 21 is provided at one end of lighting cable assembly 19 and a female receptacle 23 is provided at the other end of the cable assembly and the conductors A, B, C, G, and N are enclosed within a flexible, armored conduit 24 which in turn is secured to male plug 21 and to female receptacle 23.

Figure 2:
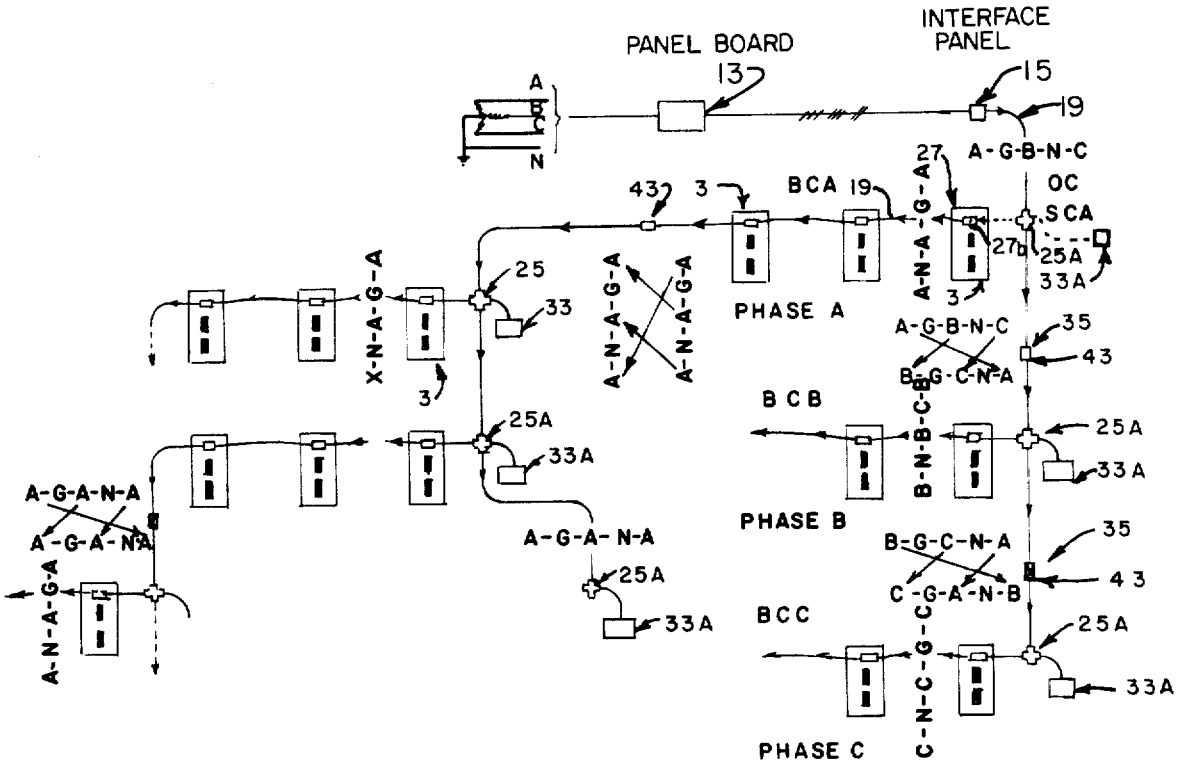
FIG. 2 is a semi-diagrammatic/schematic view of a multiplicity of fluorescent lighting fixtures energized and selectively controlled by the electrical interconnect system and method of the present invention, with a first group or branch of lighting fixtures being energized by a first phase of the three phase electrical power, with a second branch being energized by the second phase of electrical power, and with a third branch being energized by the third phase of electrical power.

Referring again to FIG. 1, the female receptacle plug 23 of lighting cable-assembly 19 is shown to be plugged into the power-in receptacle of a switch cable assembly as indicated generally by reference character 25. Generally, the construction of the switch cable assembly 25 is similar to that shown in the coassigned U.S. patent application Ser. No. 167,924, filed July 14, 1980 by Scofield et al incorporated by reference herein. Each lighting fixture 3 is typically provided with a so-called fixture adapter, as generally indicated at 27 (see FIG. 13), into which a male plug-end 21 of cable assembly 19 may be plugged or into which a switched power-out plug of switch cable assembly 25 may be plugged. More specifically, fixture adapter 27 includes a power-in receptacle **29*a* and a power-out receptacle 29*b*. Each of the receptacles is provided with five conductor pins for making electrical contact with five mating electrical conductors or pins on a corresponding male plug 21 or female receptacle 23 of a lighting cable assembly 19 or on the switched power-out receptacle of switching cable assembly 25. It will be understood that the ballasts (not shown) for lighting fixture 3 are wired in parallel to the conductors interconnecting the receptacles 29*a*, 29*b* so that the lamps of lighting fixture 3 are energized and so that power is supplied to the power out receptacle 29*a* of the fixture adapter 27. As best shown in FIG. 2, additional power cable assemblies 19 may be manually snapped into place in outlet receptacle 29*b* of fixture adapter 27 and snapped into place into the power-in receptacle 29*b* of the next successive lighting fixture 3 thereby to provide power to the remaining lighting fixtures downstream from the first switch cable assembly 25**.

As heretofore mentioned, switch cable assembly 25 includes a switched power-out receptacle 53 which may be plugged in to the power-in fixture adapter receptacle **29*a* and further includes a power-in receptacle 49 which mates with the power-outlet end 23 of lighting cable assembly 19. Additionally, the switch cable assembly includes a switch tap receptacle 55 and a straight through power out receptacle 51. The switch tap receptacle receives a switched tap cable, as indicated at 31, which may be run to a remotely mounted wall switch 33, as shown in FIG. 1. This remotely mounted wall switch 33 may be a single pole, single throw (SPST) switch, as shown in FIG. 5, for single level switching of the power downstream from the switch power-out receptacle of switch cable assembly 25, or, as shown in FIG. 6, the remote wall switch 33 may be two single throw switches, as indicated at 33A, for multi-level switching of the power downstream from the switch power-out receptacle of switch cable assembly 25A**.

As shown in FIGS. 7 and 8, other variations of the switching cable assemblies may be provided. Specifically, in FIG. 7, a switch cable assembly 25B is shown for a three-way switching application in which wall switch 33B is a single-pole, double throw switch. In FIG. 8, two circuit switching is shown in which switching cable assembly 25C is controlled by a pair of independent single pole, single throw switches 33C. The wiring and electrical operation of switch cable assemblies 25–25C and of wall switches 33–33C will be explained in greater detail hereinafter.

Further referring to FIG. 2, downstream from the straight through power out receptacle 51 of switching cable assembly 25, another power cable assembly 19 is plugged thereinto. As indicated generally at 35, means is provided between the first switch cable assembly 25 and another switch cable assembly for rotating or cross connecting the conductors or leads of the power cable assembly 19 from the first switching cable assembly leading into the rotating or cross connecting means with the leads in another power cable assembly leading from the cross connecting or rotating means to the second switch cable assembly such that the first lead A from the first switching cable assembly becomes the fifth lead to the second switching cable assembly, such that the third lead B from the first switching cable assembly becomes the first lead to the second switching cable assembly, and such that the fifth lead C from the first switching cable assembly becomes the third lead to the second switching cable assembly. This rotating of the leads is illustrated adjacent rotating coupler 43 in FIG. 2.

More specifically, the rotating or cross connecting means 35 may be a so-called crossover cable as generally indicated at 37 and as is illustrated in semi-diagrammatic form in FIG. 10. Cross over cable 37 is shown to have a power-in plug 39 and a power outlet receptacle 41. As illustrated in FIG. 10, the conductors from the first and fifth conductor pin locations in the power-in plug 39 are cross connected or rotated with the fifth and first conductor pins of the power out plug 41 so as to facilitate cross connecting of the conductors.

Alternatively, rotating or cross connecting means 35 may comprise a so-called rotating coupler, as indicated in its entirety by reference character 43 (see FIG. 2), and as is illustrated in diagrammatic form in FIG. 9. More specifically, rotating coupler 43 has a power-in receptacle 45 and a power-out receptacle 47 and, like cross over cable 37, electrical conductors within rotating coupler 43 cross connect conductor pins 1 and 5 of power inlet receptacle 45 with pins 5 and 1 of power out receptacle 47 thereby to effect a desired cross connecting or rotation of the power leads carrying the three phase power so as to permit other lighting fixtures downstream from the crossover cable 37 or downstream from the rotating coupler 43 to be energized by a selected phase of the three phase AC power and further to permit others of the downstream fixtures to be selectively energized by wall switch 33 in any desired manner.

Referring now to FIGS. 5–8, a series of switching cable assemblies of different internal wiring and of different external wall switch configurations is shown for different applications. More specifically, in FIG. 5, a single level switching cable assembly, as indicated in its entirety by reference character 25, is shown having a power-in receptacle 49, a power-out receptacle 51, a switched power-out receptacle 53 adapted to be received in the power-in receptacle **29*a* of fixture adapter 27 in lighting fixture 3, and a switch tap receptacle 55 for receiving one end of a switch tap cable 31 leading to a wall switch 33. In FIG. 5, it will be noted that the wall switch 33 is a single pole, single throw switch, as indicated at S1, and it basically makes and breaks an electrical circuit leading from conductor pins 1 of power-in receptacle 49 to power-out receptacle 51 and to conductor pins 1 and 3 of the switched power-out receptacle 53. In this manner, one phase of electrical power, for example phase A, together with ground conductor G and neutral conductor N may be supplied to the switch power-out receptacle 53 for energizing a lighting fixture 3 into which the switch power-out receptacle is plugged and for energizing a branch of successive lighting fixtures which are energized by jumper cables, as shown in FIG. 1, which are plugged into the power-out receptacle 29*b* of fixture adapter 27**.

In FIG. 6, an alternative embodiment of a switching cable assembly is indicated in its entirety by reference character 25A for multi-level switching. It will be understood that reference characters followed by the "A" suffix indicate corresponding parts having corresponding functions to the reference characters described above in regard to the switching cable assembly 25 of FIG. 5. However, it will be noted that the wall switch 33A includes two independently operable switches, S1 and S2, for making and breaking a circuit from pins 1 of the power-in receptacle 49A and the power-out receptacle 51A with pins 1, 3, and 5 of the switching power-out receptacle 53A thereby to provide multi-level switching of downstream lighting fixtures 3 in a manner as will be more fully hereinafter described.

In FIG. 7, still another variation of a switching cable assembly is indicated in its entirety by reference character 25B. In switching cable assembly 25B, wall switch 33B is shown to be a single pole, double throw switch which makes and breaks a circuit extending from the conductor between pins 1 of power-in receptacle 49B and power-out receptacle 51B and pins 3 and 5 of switch power out receptacle 53B. This permits three way operation of the switch cable assembly via wall switch 33B.

Still another variation of a switching cable assembly is illustrated in its entirety by reference character 25 C in FIG. 8. Wall switch 33C is shown to comprise two separate, independently operable single pole, single throw switches for selectively energizing two circuits or two different phases of the three phase power fed into power in receptacle 49C. More specifically, the first circuit is controlled by switch at the lefthand side of wall switch 33C (as it is viewed in FIG. 8) which makes and breaks a circuit extending between pins 1 of both power in receptacle 49C and power-out receptacle 51C and pin 1 of switched power-out receptacle 53C. Still further, another independently operable SPST switch is provided in wall switch 33C which selectively makes and breaks circuits between conductor pins 3 of receptacles 49C and 51C and pin 5 of switch power-out receptacle 53C. Thus, by independent, selective operation of the two SPST switches in wall switch 33C, independent operation of the two circuits or phases fed into switching cable assembly 25C by means of pins 1 and 3 of power-in receptacle 49C can be achieved.

In all instances with switching cable assemblies 25, 25A, 25B, and 25C, it will be noted that the power-in and power-out receptacles 49 and 51, respectively, have the same ordering of conductors. In other words, power is transmitted straight through the switching cable assembly from the power-in receptacle to the power-out receptacle and the order of the conductors is not changed.

In FIG. 11, the internal conductors of the distribution interface panel 15 is illustrated. Specifically, the conduit service line 16 is shown to bring two independent circuits each having three phase AC power therein to supply two different interface power-out receptacles. It will be understood that lighting cable assemblies 19 may be readily received in either receptacle 57 or 59 of distribution interface panel 15.

Referring to FIGS. 2-4 and 17, a typical lighting system for a commercial building utilizing a plurality of lighting fixtures 3 electrically interconnected to a source of three phase AC power by the electrical interconnect system and method of this invention will be described. In FIG. 2, it is seen that three phase AC power is conducted from distribution interface 15 to a first multi-level switching connecting assembly 25A by means of a power cable assembly 19. At the first multi-level switching cable assembly, a first phase of electrical power (e.g., phase A) is split off from the incoming power and is conducted downstream to a first branch circuit BCA via a variety of cables 19 interconnected to fixture adapters 27 carried by lighting fixtures 3. As will be hereinafter explained, operation of various groups of lighting fixtures 3 within each branch circuit BCA may be controlled by a variety of additional single level switching cable assemblies 25 and corresponding wall switches 33 or by other multi-level switching cable assemblies 25A and corresponding multi-level wall switches 33A. Still referring to FIG. 2, other power cable assemblies 19 are interconnected to the power out receptacle 51A of the first multi-level switching cable assembly 25A such that electrical power including the unused phases (e.g., phases B and C) are conducted downstream to other branch lighting circuits, as indicated at BCB and BCC. These other branch circuits are similar to branch circuit BCA, as described above, but are energized by another of the remaining phases (e.g., either phase B or C).

Figure 4:
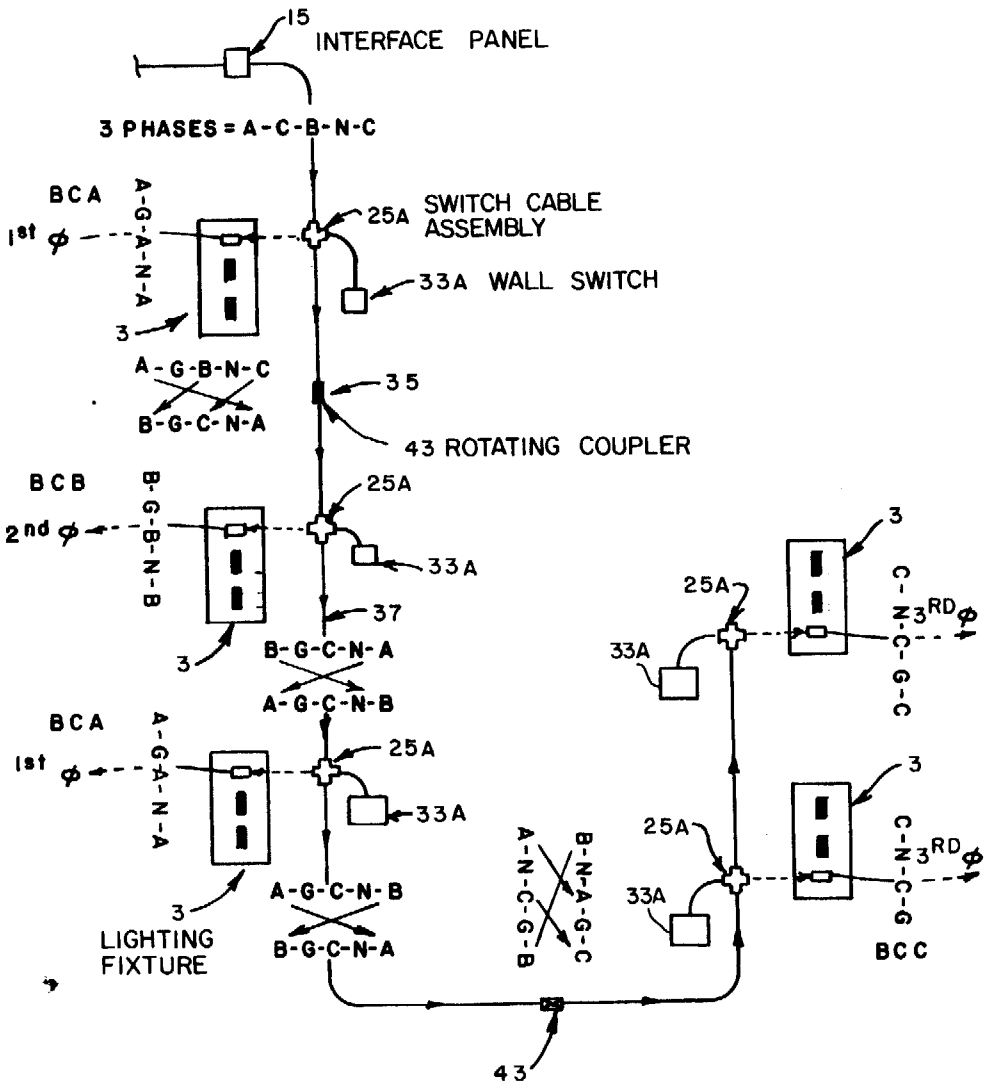
FIG. 4 is a circuit generally similar to that shown in FIG. 3 in which the circuits of the different phases are utilized in irregular order.
Figure 3:
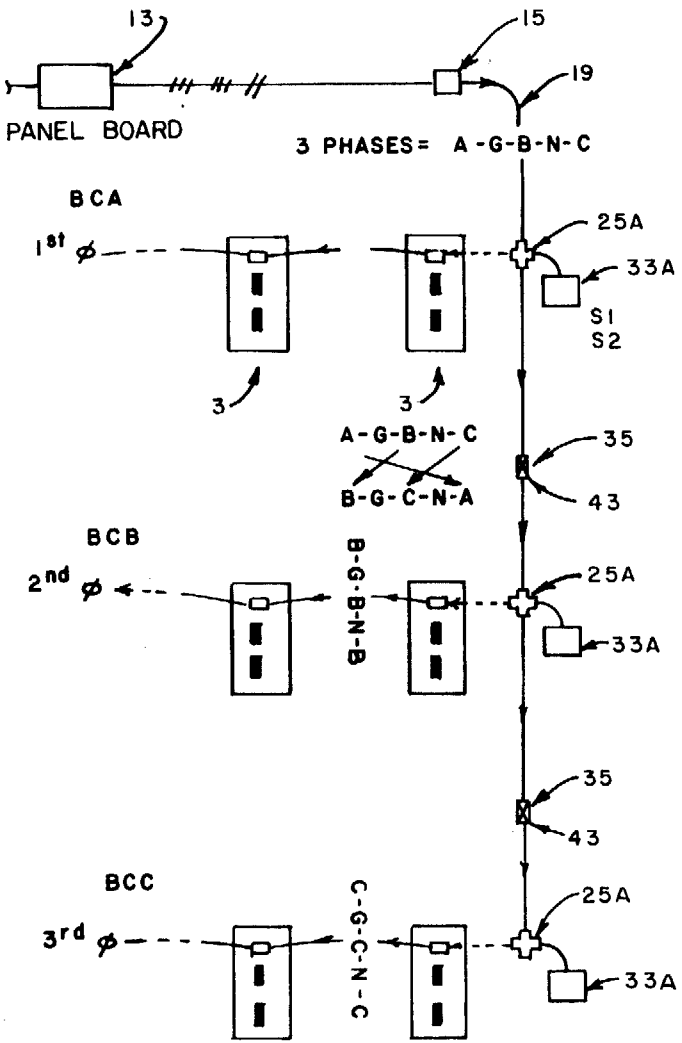
FIG. 3 is a portion of the electrical interconnect system illustrated in FIG. 2 showing three branch circuits in which three phase electrical power is utilized in regular order such that the first branch circuit is energized by the first phase of electrical power, such that the second branch circuit is energized by the second phase of electrical power, and such that the third branch circuit is energized by the third phase of electrical power.
Figure 15:
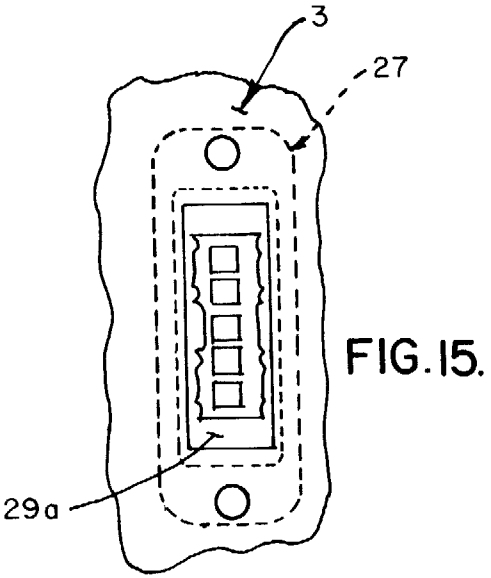
FIG. 15 is a view taken along line 15—15 of FIG. 13, illustrating the conductor receptacles of the adapter receptacle.
Figure 14:
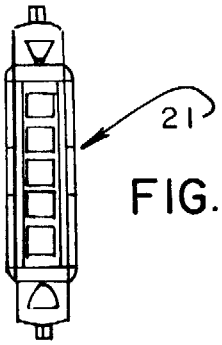
FIG. 14 is an end view of the connector taken along line 14—14 of FIG. 13 illustrating the conductor pins of the connector.

Portions of the multi-circuit run shown in FIG. 2 are illustrated in somewhat greater detail in FIGS. 3 and 4. More specifically, in FIG. 3, the branch circuits utilize the three phases of electrical power (A, B, and C) in regular order such that the first branch circuit is energized by the first phase A, the second branch circuit BCB is energized by the second phase B, and such that the third branch circuit BCB is energized by the third phase C. However, in FIG. 4, a circuit is illustrated in which different phases may be utilized in irregular order such that, for example, the first branch circuit BCA is energized by the first phase of electrical power (phase A), such that the second branch circuit BCB is energized by a second phase of electrical power (phase B), such that a third branch circuit BCA' is again energized by the first phase A of electrical power with a cross-over cable 37 (as illustrated in FIG. 10), being provided between the multi-level switch cable assemblies 25 between branch circuits BCB and BCA'. Still further, a third branch circuit BCC is provided downstream from the branch circuit BCA'.

Figure 17:
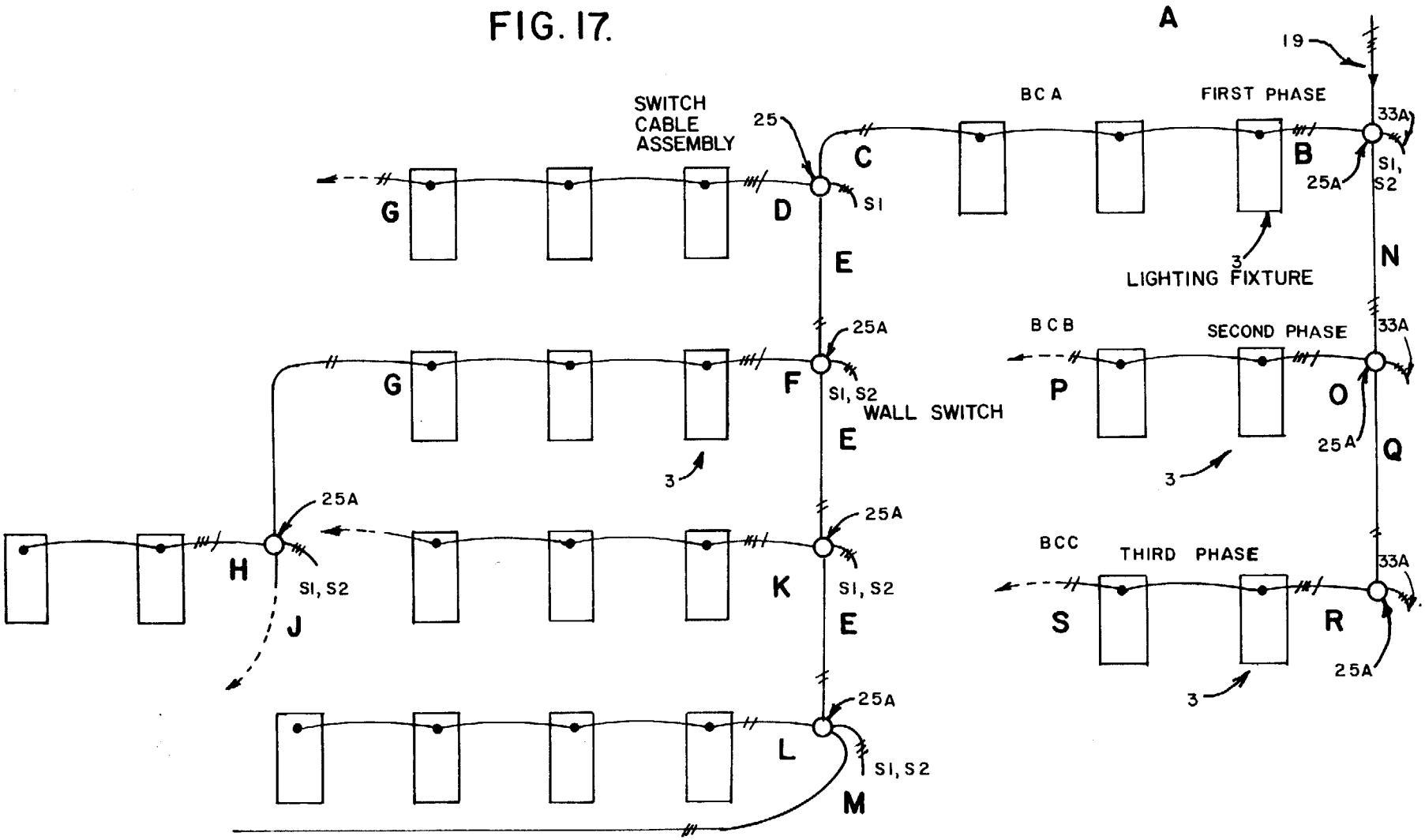
FIG. 17 is a diagrammatic view of the system and method of the instant invention which provides an overview of the salient features of the instant invention.

Referring now to FIG. 17, a lighting circuit, generally similar to that illustrated in FIG. 2 is shown, but FIG. 17 includes a number of reference letters, as indicated by the enlarged letters A-S, for serving as reference points on FIG. 17 to aid in the description of the construction and operation of the electrical interconnect system and method of the present invention. More specifically, in FIG. 17, reference letter A denotes a branch run from a lighting panelboard 13 via a distribution interface panel 15 and via a cable assembly 19. The outlet end 23 of cable assembly 19 plugs into the power inlet receptacle 49A of a multi-level switch cable assembly 25A and the switched power-out receptacle 53A of switching cable assembly 25A supplies a single phase of power for energizing the first branch circuit BCA. The power exiting switching cable assembly 25A via switch power out receptacle 53A is indicated by reference letter B on FIG. 17. Thus, a number of lighting fixtures 3 may be selectively connected to the first phase branch circuit BCA by the switches S1 and S2 contained in the remote wall switch 33A interconnected to the switch tap receptacle 55A of the first switch cable assembly 25A for multi-level switching of a lamp fixtures 3 in branch circuit BCA. It will be understood that two levels of switching will result if four-lamp fixtures are utilized while three levels of independent switching will be available with this arrangement if three-lamp fixtures are utilized in branch circuit BCA.

At reference letter C in FIG. 17, it will be understood that an unswitched leg of the first phase of branch circuit BCA extends from reference point B through the last fixture to a second downstream switch point, as indicated by reference letter D. A number of additional lighting fixtures 3 may be connected to the unswitched leg of the first phase circuit through one wall switch S1 via a single level switch cable assembly 25 for single level switching of the lamp fixtures 3 extending on the subbranch line between reference points D and G. As previously noted, the power exiting a switching cable assembly 25 via the power outlet receptacle 51 is in the same order utilizing the same conductors as the power fed into the switching cable assembly via its respective power-in receptacle 49. Thus, the unswitched leg of the first phase circuit of branch circuit BCA extends through the first single level switching cable assembly 25, as indicated at reference character E, and is fed into the power inlet receptacle 49 of a next multi-level switching cable assembly 25A. A second subbranch circuit of lighting fixtures, this time capable of multi-level switching, extends from the switched power out receptacle of this next multi-level switching cable assembly, as indicated by reference characters F, G, H, and J. Similarly, the unswitched leg of the first phase of the first branch circuit BCA extends through additional multi-level switching cable assemblies to form other subbranch circuits, as indicated at K and L, and the circuit can continue on to still other switching cable assemblies (not illustrated), as indicated by reference M.

Referring now to the upper righthand corner of FIG. 17, it will be seen that a continuation of the second and third phase circuits exiting the power-out receptacle 51A of the first multi-level switching cable assembly 25A continues, as indicated by reference character N. A second branch circuit, as indicated at BCB, may be branched off the second multi-level switching cable assembly 25A, as indicated by reference characters 0 and P, such that the second branch circuit is energized by the second phase of electrical power. Still further, the third phase of electrical power continues through the second multi-level switching cable assembly 25A to a third multi-level switching cable assembly with this third phase of electrical power being generally indicated by reference character Q. Likewise, a third branch circuit, as indicated at BCC, can be energized by a third phase of electrical power exiting the third multilevel switching cable assembly 25A between reference characters R and S.

Figure 16:
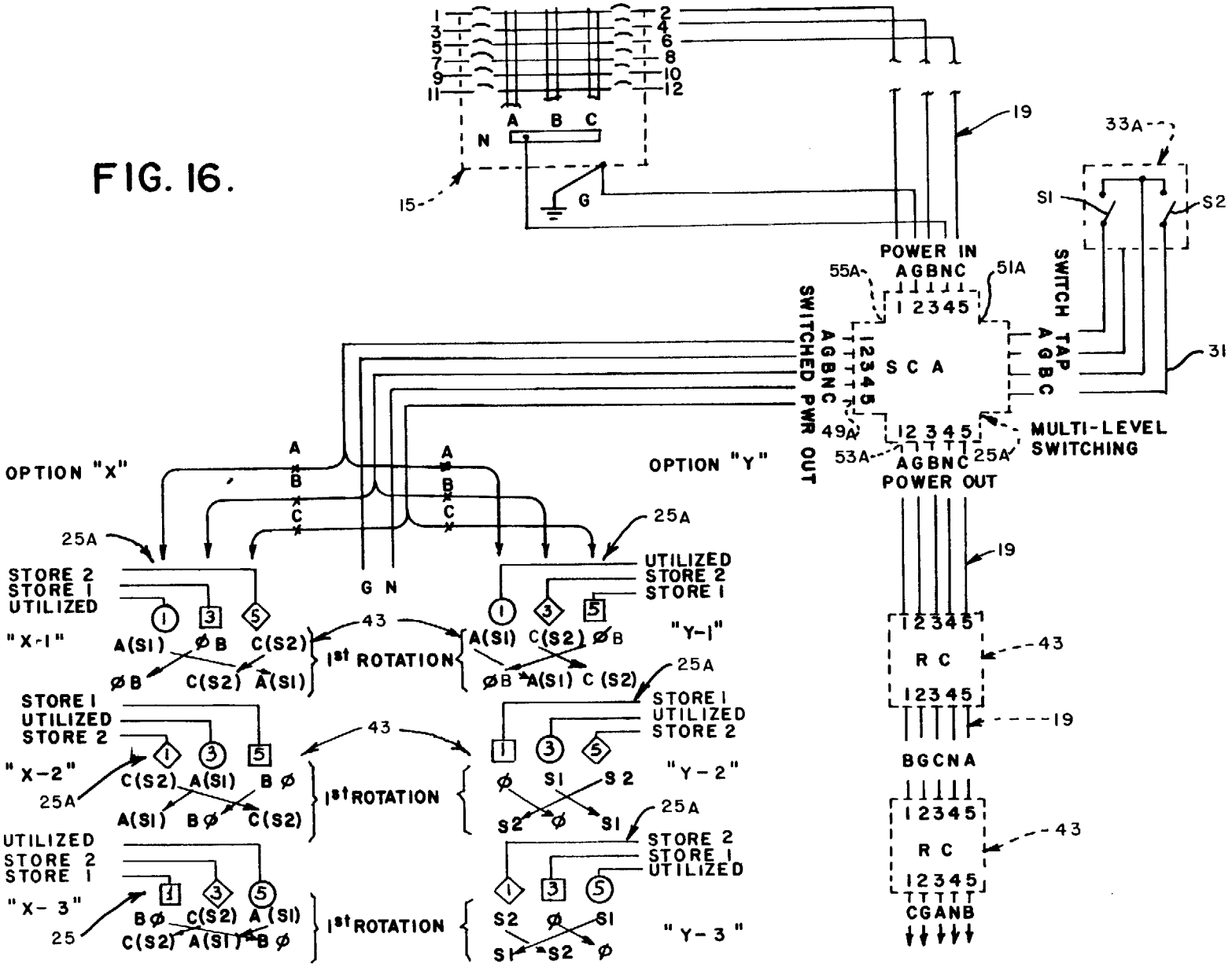
FIG. 16 is a diagrammatic view of the interconnect system of this invention showing two conductor rotation options.

Referring now to FIG. 16, it will be understood that the power-in receptacle 49 and the power-out receptacle 51 of any switching cable assembly 25 may be designed for any ordering of the conductors relative to the conductor pin 1-5 locations according to a number of options. Within the broader aspects of this invention, a variety of different arrangements of conductor pin locations in the switching cable assemblies, power conductor cables 19, rotating couplers 43, and other key components of this interconnect system may utilize a variety of conductor location sequences However, in the broadest sense of the system and method of this invention, it is preferred that the conductors coming into the power in receptacle 49 of an switching cable assembly be in the following order: a first phase "hot" conductor; a ground conductor; a second phase "hot" conductor; a neutral conductor; and a third phase "hot" conductor It will be understood, however, that the location of the ground and neutral conductors may be interchanged between the second and fourth pin positions within the receptacles of the switching cable assemblies, power cable assemblies, and other components. Further, it will be understood that within the broader aspects of this invention, it is not necessary that the first phase power conductor occupy the first pin position.

More specifically, it has been found that an optimal arrangement of the "hot" conductors and of the ground and neutral conductors results in rotation of the conductors for proper sequencing enabling downstream remote switching and further enabling an optimization or minimization of the number of different components required for utilization of the electrical interconnect system and method of this invention. This-preferred wiring of the switch power out receptacles 53 of the switching cable assemblies 25 has been found to be preferable if it follows either a so-called option "X" or an option "Y" sequence, as is illustrated in FIG. 16.

More specifically, referring to FIG. 16, it will be seen that the three phase alternating current fed into the power-in receptacle 49A of switching cable assembly 25A via a power cable assembly 19 has the first, second, and third phases of the power designated, respectively, by reference characters A, B, and C, connected to conductor pins 1, 3, and 5 of receptacle 49A. As shown, ground conductor G is connected to pin 2 and neutral conductor N is connected to pin 4, but it will be understood that the ground and neutral conductors can be interchanged.

FIG. 16, under option "X", it is seen that the first phase A conductor is utilized for energization of a first subbranch of lighting fixtures and that this first subbranch of lighting fixtures is controlled by switch S1 of wall switch 33A connected to the switch tap 51A of the first switching cable assembly 25A. The other two phases A and B are not utilized for energization of lighting fixtures at this point in the circuit and thus are indicated as being stored. Downstream from notation "X-1", a first rotating coupler 43 is provided such that the first phase A coupled to the first conductor pin is, within the rotating coupler, rotated so it is coupled with the fifth conductor pin. Likewise, the unswitched phase B is rotated from the third conductor pin to the first conductor pin and the third phase C (which is selectively switched by switch S2) is rotated the fifth conductor pin to the third conductor pin. Then, at position "X-2", the "hot" conductors connected to pin locations 1 and 5 are stored whereas the conductor connected to pin 3 is utilized for energization of another subbranch of lighting fixtures while the "hot" conductors attached to conductors pins 1 and 5 are stored.

Thence, downstream from position "X-2", another rotating coupler 43 is provided which rotates the pin positions in exactly the same order as the first rotating coupler at "X-1". In particular, under the "X" option, it will be noted that pin position 1, in each rotating coupler 43, is rotated to pin position 5 and that pin position 3 is rotated to pin position 1 and that pin position 5 is rotated to pin position 3.

Under the "Y" option, the conductor at the power-in receptacle of rotating coupler 43 is rotated to pin position 3, the power-in pin position 3 is rotated to the fifth power out conductor pin location, and the fifth power-in pin position is rotated to the first power-out conductor pin position.

Figure 18:
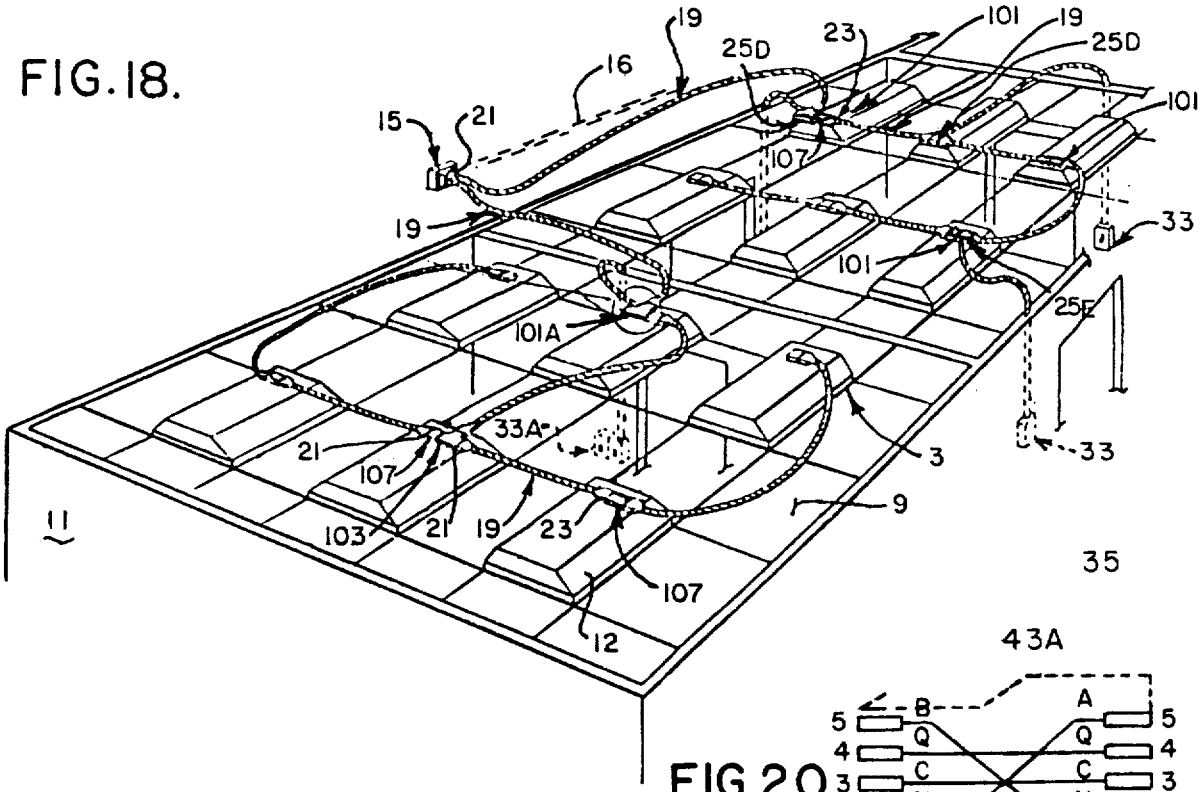
FIG. 18 is a perspective view similar to FIG. 1 of another arrangement of lighting fixtures installed in a suspended ceiling and with the lighting fixtures in the room in the foreground being energized by two phase AC power and with the fixtures in the room in the background being powered by three phase power, and with the lighting fixtures being supplied with power via an alternative embodiment of the interconnection system of this invention.

Referring now to FIGS. 18-25, a variation of the electrical interconnection system and method of the present invention is illustrated. Generally, FIG. 18 is similar to FIG. 1 showing a plurality of lighting fixtures supported in a suspended ceiling 5. Three phase electrical power is supplied to a distribution interface panel 15 by means of a suitable conduit supply line 16. Power is then supplied from distribution interface panel 15 to the various lighting fixtures by means of power cables 19 and other components of the electrical interconnect system 1 as will be hereinafter described in greater detail.

Figure 19:
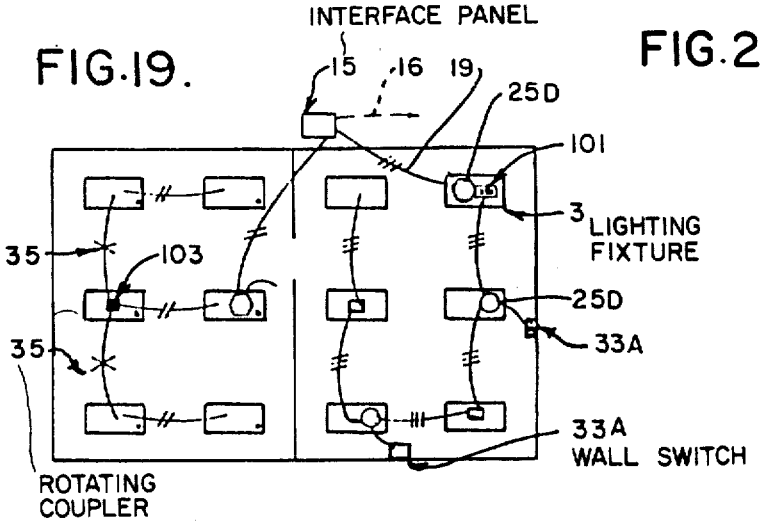
FIG. 19 is a schematic view of the fixtures and interconnection system illustrated in FIG. 18.

Referring specifically to FIGS. 18 and 19, the variation of the electrical interconnect system 1 of the present invention shown in these drawing figures includes a room shown in the foreground of FIG. 18 and in the lefthand portion of FIG. 19 which is supplied with two phase AC electrical power from distribution interface panel 15 and another room, as shown in the background of FIG. 18 or on the righthand side of FIG. 19, which is supplied with three phase AC power from distribution interface panel 15. Referring first to the portion of the electrical distribution system supplied with three phase electrical power, it will be noted that power from the distribution interface panel is supplied to the lighting fixtures by means of a suitable power cable assembly 19 which in turn is supplied to a switching cable assembly 25D. This switching cable assembly 25D is generally similar to the single level switching cable assembly 25 illustrated in FIG. 5 and heretofore described. However, the primary difference between the switching cable assembly 25 and the switching cable assembly 25D is that switching cable assembly 25 was intended to be plugged into the power end fixture adapter receptacle **29*a* as is best illustrated in FIG. 1. In contradistinction, the variation of the electrical interconnect system 1 illustrated in FIGS. 18-25 is that the fixture adapter receptacles 29*a* and 29*b* have been omitted from lighting fixture 3 and in their place, the frame 12 for lighting fixture 3 is provided with a suitable aperture (not shown) adapted to receive a spring loaded bayonet-type securement (also not shown) provided on the bottom of a so-called fixture adapter, as generally indicated at 107, which may be snapped into place within the aperture provided in the fixture frame 12. As illustrated in FIGS. 23 and 24, a plurality (e.g., four) of leads, as indicated at L1-L4, extend into the lighting fixture and may be selectively connected to the ballasts within the lighting fixtures for either single level control (as shown in FIG. 23) or for multi-level control (as shown in FIG. 24). More specifically, single level control is defined such that all of the lamps controlled by the ballast within these lighting fixtures are simultaneously energized and de-energized. On the other hand, multi-level control independently wires the inboard lamp ballast and the outboard lamp ballast so that the inboard and outboard lamps of the lighting fixture may be independently, selectively controlled by means of multiple level switching as from wall switches 33A such that the intensity of the lighting within the room may be varied. Further referring to FIG. 23 and 24, it will be noted that each of the fixture adapters 107 includes a power in receptacle 109 and a power out receptacle 111 such that other components, such as an appropriate switch cable assembly 25D or an appropriate power cable 19**, may be plugged into place within the fixture adapter.

Figure 20:
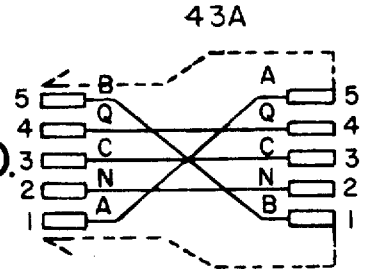
FIG. 20 is a schematic view similar to FIG. 9 of a rotating coupler or crossover for two circuits.
Figure 21:
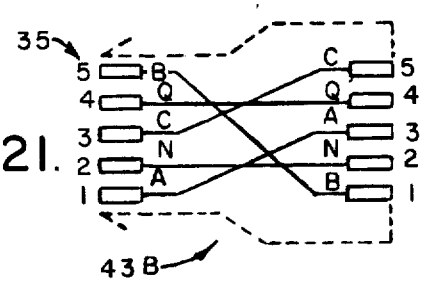
FIG. 21 is a schematic similar to FIG. 20 of a rotating coupler or crossover for three circuits.

Referring to FIGS. 20 and 21, alternate means 35 for rotating the orientation of the conductors within the various electrical components is shown to comprise a so-called two circuit crossover or rotating coupler as generally indicated at 43A and 43B, as is shown in FIG. 20 and 21, respectively. It is believed, especially in view of the previous descriptions of rotating connector 43, as heretofore described and as is shown in FIG. 9, that the construction and operation of the two circuit rotating connector 43A (FIG. 20) and the three circuit rotating connector 43B (FIG. 21) will be readily apparent to those skilled in the art.

Figure 22:
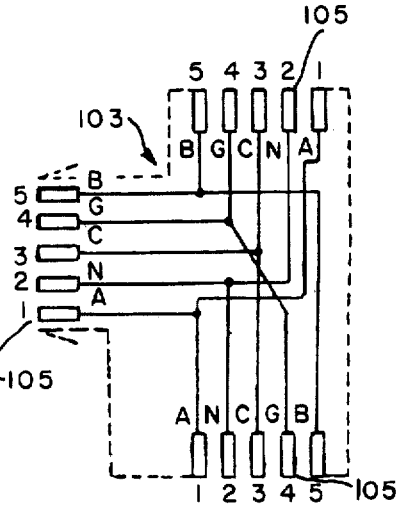
FIG. 22 is a schematic of a circuit splitter.

Referring now to FIG. 22, a so-called circuit splitter, as indicated generally at 103, is shown. Such a circuit splitter may be utilized in any circuit, whether the circuit is single phase, two phase or three phase. Specifically, the circuit splitter 103 is shown in FIG. 18 in the two phase portion of the lighting circuit shown so as to receive power from the first lighting fixture and to split the power in substantially equal circuits to the remaining lighting fixtures.

Referring now to FIG. 25, the various components of the alternative embodiment of the electrical interconnect system 1 of the present invention will be described for a branch circuit, such as BCA, as illustrated in FIGS. 2-4. More specifically, this branch circuit includes a multi-level, three way switch cable assembly, as indicated generally by 25B'. It will be understood that the "primed" reference characters indicate parts having a corresponding construction and function to similar parts heretofore described. The power in receptacle 55B' of switching cable assembly 25B' receives three phase power from electrical distribution panel 15 and is so constructed so that one phase of the three phase power (e.g., phase A) can be selectively opened and closed, and can be selectively switched between the first and fifth conductor pins of the switched power out receptacle of the switching cable assembly 25B' by means of a wall mounted selector switch 33B'.

As further shown in FIG. 25, this single phase switch power is conducted to a suitable rotating coupler 43C by means of a power cable 19. Since only single phase power together with the ground and neutral leads must be conducted through the rotating coupler 43C, the wiring of the rotating coupler 43C may be as shown such that power from the first terminal of the switch power in receptacle is rotated so as to be applied to the third terminal of the switch power out receptacle of rotating coupler 43C. Then, power from rotating coupler 43C is transmitted to another switching cable assembly, as indicated generally at 25D, for so-called four way control. Switching cable assembly 25D includes a wall mounted control switch 33D for selectively controlling the switch power out of switching cable assembly 25D to a so-called second three-way control or rotating coupler, as generally indicated at 43D. It will be seen that this second three way rotating coupler has leads L1-L4 connected to respective leadwire pigtails which may be connected directly to the ballasts of the lighting fixture 3 in the manner heretofore described in regard to the fixture adapters 107 illustrated in FIGS. 23 and 24.

It will be understood that, within the broader aspects of this invention, the terms first, second, third, fourth, and fifth leads or conductors, as utilized in the claims, need not require an ordered relationship between the various conductors and need not represent or be associated with any specific "hot" conductor for three phase AC power, but rather are used as descriptive identifiers for tracing or identifying specific conductors as they are rotated thereby to permit single level and multi-level switching of branching lighting circuits. It will be further understood that one or more of the conductors may be eliminated from any of the electrical components if, for example, two phone AC power is used.

In view of the above, it will be seen that the other objects of this invention are achieved and other advantageous results obtained.

As various changes could be made in the above constructions or methods without departing from the scope of the invention, it is intended that all matter contained in the above description or shown in the accompanying drawing shall be interpreted as illustrative and not in a limiting sense.

What is claimed is:

1. An electrical interconnect system for multiple lighting fixtures comprising:

a source of three phase alternating current electrical power;

a plurality of lighting fixtures;

a first switching cable assembly between said power source and successive lighting fixtures;

a plurality of power cables, each cable having a first, a second, a third, a fourth, and a fifth lead, one of said power cables extending from said power source to said first switching cable assembly;

said first switching cable assembly having internal circuit connections for connecting a first series of lighting fixtures to at least said first, second, and fourth leads with said fixtures of said first series of fixtures being energized by at least a first phase of said three phase electrical power;

a first switch connected to said first switching cable assembly for selectively energizing and de-energizing said first series of lighting fixtures;

a second switching cable assembly electrically connected to said first switching cable assembly via others of said power cables;

means between said first and second switching cable assemblies for cross-connecting the leads of said power cables from said first switching cable assembly to said cross-connecting means with other leads in said power cables from said cross-connecting means to said second switching cable assembly such that said first lead from said first switching cable assembly becomes the third lead to said second switching cable assembly, said third lead from said first switching cable assembly becomes said fifth lead to said second switching cable assembly, and said fifth lead from said first switching cable assembly becomes said first lead to said second switching cable assembly;

said second switching cable assembly having internal circuit connections for connecting a second series of lighting fixtures to said third, second and fourth leads relative to said first switching cable assembly with the lighting fixtures of said second series of lighting fixtures being energized by a second phase of said three phase electrical power; and a second switch connected to said second switching cable assembly with said first switch being operable to control energization and de-energization of said first series of fixtures without interference with the operation of said second series of lighting fixtures and with said second switch being operable to control energization and de-energization of said second series of lighting fixtures without interference with the operation of said first series of lighting fixtures.

2. An electrical interconnect system as set forth in claim 1 further comprising:

a third switching cable assembly electrically connected to said second switching cable assembly via power cables;

means between said second and third switching cable assemblies for cross-connecting the leads of said cable from said first and second switching cable assemblies to said second cross-connecting means with other leads in said power cable from said cross-connecting means to said third switching cable assembly such that said first lead from said first switching cable assembly becomes said third lead of said third switching cable assembly, said second lead of said first switching cable assembly becomes the fifth lead of said third switching cable assembly, and such that said fifth lead of said first switching cable assembly becomes the first lead of said third switching cable assembly;

said third switching cable assembly having internal circuit connections for connecting a third series of lighting fixtures to said fifth, second, and fourth leads relative to said first switching cable assembly with the lighting fixtures of said third series of lighting fixtures being energized by a third phase of said three phase electrical power; and a third switch connected to said third switching cable assembly with said third switch being operable to control energization and de-energization of said third series of lighting fixtures without interference with the operation of either the first or second series of lighting fixtures.

3. In an electrical interconnect system as set forth in claim 1 wherein said cross-connect means is a power cable having said first through fifth power leads in order at one end thereof with the first, third and fifth leads at the power in end of said cross connect means becoming the fifth, second, first, fourth, and third at the power out end of said power cable.

4. An electrical interconnect system as set forth in claim 1 wherein said cross connect means is a coupler having a body with a power-in receptacle at one end and with a power-out receptacle at the other end and further having five terminals in each receptacle and having internal conductors selectively connecting a terminal at the power-in receptacle with a desired terminal at the power-out receptacle, with the first terminal at the power-in receptacle being connected to the fifth terminal of the power-out receptacle, with the third terminal of the power-in receptacle being connected to the first terminal of the power-out receptacle, and with the fifth terminal of the power-in receptacle being connected to the third terminal of the power-out receptacle and with the second and fourth terminals of the power in receptacle being connected to respective second and fourth terminals of the power-out receptacle.

5. An electrical interconnect system as set forth in claim 1 wherein each of switching cable assemblies comprises a housing having a power-in receptacle for receiving a respective power cable, a second receptacle for receiving another power cable constituting a power-through cable, said power-in and said power-out receptacles each having five terminals therewithin and said switching cable assembly further having conductor means connecting the terminals of said power-in receptacle with corresponding terminals of said power-out receptacle such that the order of the leads of the power-out receptacle is the same as the leads of said power-in receptacle; said switching cable assembly further having a third receptacle having five terminals therein, the third receptacle receiving a power cable for energization of a respective series of lighting fixtures with a single phase of said three phase power, said switching cable assembly having means interconnecting the terminals of said third receptacle with the terminals of said power-in receptacle such that when the series of lighting fixtures is energized, the first, third, and fifth terminals of the third receptacle are electrically connected to the first terminal of the power-in receptacle and such that the second and fourth terminals of the third receptacles are electrically connected to the second and fourth terminals of the power-in receptacle.

6. An electrical interconnect system as set forth in claim 1 wherein two phase electrical power is supplied to said first series of lighting fixtures by said first switching cable assembly, and wherein said first switch for said first switching cable assembly is operable for selectively, independently controlling the first and second phase power circuits in said first series of lighting fixtures, and wherein said lighting fixtures in said first series of lighting fixtures have a first group of lamps having a first ballast connected thereto and a second group of lamps with a second ballast connected thereto, said first ballast being connected to said first power phase and said second ballast being connected to said second power phase such that upon selected operation of said first switch one or both groups of lamps may be selectively energized and de-energized thereby to give multi-level lighting control of said fixtures.

7. Method of interconnecting a plurality of lighting fixtures into one or more series of successive fixtures with the fixtures being energized by means of three phase alternating current electrical power utilizing five lead power cables with each of the series of fixtures being selectively energizable and de-energizable with respect to and independently relative to one another, said method comprising the steps of:

extending a first power cable having a first, a second, a third, a fourth, and a fifth lead therein from a source of three phase alternating current electrical power;

connecting said first power lead to a first switching cable assembly;

branching a first circuit from said first switching cable assembly for energizing said first series of lighting fixtures at least with said first series of lighting fixtures being energized by a first phase of power using said first, second, and fourth leads;

connecting a remotely operable first switch to said first switching cable assembly for selectively controlling energization and de-energization of said first series of lighting fixtures;

continuing said three phase power from said first switching cable assembly to a second switching cable assembly with the leads exiting the first switching cable assembly being in the same order as the leads entering said first switching cable assembly;

cross connecting said leads between said first and second switching cable assemblies such that said first lead from said first switching cable assembly becomes the fifth lead to said second switching cable assembly, said third lead from said first switching cable assembly becomes the first lead to said second switching cable assembly, and so that said fifth lead from said first switching cable assembly becomes the third lead to said second switching cable assembly;

branching a second circuit from said second switching cable assembly for energizing a second series of fixtures by a second phase of said three phase electrical power using said third, second, and fourth leads relative to said first switching cable assembly; and connecting a remotely operable second switch to said second switching cable assembly for selectively controlling energization and de-energization of said second series of fixtures.

8. Method of claim 7 wherein the method further comprises the steps of continuing said three phase power from said second switching cable assembly to a third switching cable assembly with the leads exiting said second switching cable assembly being in the same order as the leads entering said second switching cable assembly;

cross-connecting said leads between said second and said third switching cable assemblies such that said first lead from said second switching cable assembly becomes the fifth lead to said third switching cable assembly, said third lead from said second switching cable assembly becomes the first lead to said third switching cable assembly, and so that said fifth lead from said second switching cable assembly becomes the third lead to said third switching cable assembly;

branching a third circuit from said third switching cable assembly for energizing a third series of fixtures by third phase of electrical power of said three phase electrical alternating current power source using said third, second, and fourth leads relative to said first switching cable assembly; and connecting a remotely operable third switch to said third switching cable assembly for selectively controlling energization and de-energization of said third series of fixtures.

9. An electrical interconnect system for multiple lighting fixtures energized by a source of three phase alternating current electrical power, said system comprising:

a plurality of lighting fixtures;

a first switching cable assembly between said power source and successive lighting fixtures;

a power cable having at least a first phase lead, a second phase lead, a third phase lead, and a neutral lead, one of said power cables extending from said power source to said first switching cable assembly;

said first switching cable assembly having internal circuit connections for connecting a first series of lighting fixtures to at least said first phase lead and to said neutral lead with said fixtures of said first series of fixtures being energized by said first phase of said three phase electrical power;

a first switch connected to said first switching cable assembly for selectively energizing and de-energizing said first series of lighting fixtures;

a second switching cable assembly electrically connected to said first switching cable assembly via others of said power cables;

means between said first and second switching cable assemblies for cross-connecting the leads of said power cables from said first switching cable assembly to said cross-connecting means with the leads in said power cables from said cross-connecting means to said second switching cable assembly such that said one of the other phase leads from said first switching cable assembly becomes the first phase lead to said second switching cable assembly, and the remaining phase lead from said first switching cable assembly becomes the second phase lead to said second switching cable assembly; and said second switching cable assembly having internal circuit connections for connecting a second series of lighting fixtures to said first phase lead of said second switching cable assembly with the lighting fixtures of said second series of lighting fixtures being energized by another phase of said three phase electrical power.

10. An electrical interconnect system as set forth in claim 9 wherein a second switch is connected to said second switching cable assembly with said first switch being operable to control energization and de-energization of said first series of fixtures without interference with the operation of said second series of lighting fixtures and with said second switch being operable to control energization and de-energization of said second series of lighting fixtures without interference with the operation of said first series of lighting fixtures.

11. An electrical interconnect system as set forth in claim 10 further comprising:

a third switching cable assembly electrically connected to said second switching cable assembly via others of said power cables;

second means between said second and third switching cable assemblies for cross-connecting the leads of the power cable from said first and second switching cable assemblies to said second cross-connecting means with other leads in said power cable from said cross-connecting means to said third switching cable assembly such that the remaining phase lead from said first switching cable assembly becomes the first phase lead of said third switching cable assembly; and said third switching cable assembly having internal circuit connections for connecting a third series of lighting fixtures thereto with the lighting fixtures of said third series of lighting fixtures being energized by a third phase of said three phase electrical power.

12. An electrical interconnect system as set forth in claim 11 wherein a third switch is connected to said third switching cable assembly with said third switch being operable to control energization and de-energization of said third series of lighting fixtures without interference with the operation of either the first or second series of lighting fixtures.

13. In an electrical interconnect system as set forth in claim 9 wherein said cross-connecting means is a power cable having first through fifth leads in order at one end thereof with the first, third and fifth leads at the power in end of said cross connect means becoming the fifth, second, first, fourth, and third leads at the power out end of said power cable.

14. An electrical interconnect system as set forth in claim 9 wherein said cross connecting means is a coupler having a body with a power-in receptacle at one end and with a power-out receptacle at the other end and further having five terminals in each recptacle and having internal conductors selectively connecting a terminal at the power-in receptacle with a desired terminal at the power-out receptacle, with the first terminal at the power-in receptacle being connected to the fifth terminal of the power-out receptacle, with the third terminal of power-in receptacle being connected to the first terminal of the power-out receptacle and with the fifth terminal of the power-in receptacle being connected to the third terminal of the power-out receptacle and with the second and fourth terminals of the power in receptacle being connected to respective second and fourth terminals of the power-out receptacle.

15. An electrical interconnect system as set forth in claim 9 wherein each of switching cable assemblies comprises a housing having a power-in receptacle for receiving a respective power cable, a power-out receptacle for receiving another power cable constituting a power-through cable, said power-in and said power-out receptacles each having five terminals including a ground and a neutral therewithin and said switching cable assembly further having conductor means connecting the terminals of said power-in receptacle with corresponding terminals of said power-out receptacle such that the order of the leads of the power-out receptacle is the same as the leads of said power-in receptacle; said switching cable assembly further having a third receptacle having five terminals therein, the third receptacle receiving a power cable for energization of a respective series of lighting fixtures with a single phase of said three phase power, said switching cable assembly having means interconnecting the terminals of said third receptacle with the terminals of said power-in receptacle such that when the series of lighting fixtures is energized, at least the first terminal of the third receptacle is electrically connected to the first terminal of the power-in receptacle and such that the ground and the neutral terminals of the third receptacle are electrically connected to the respective ground and neutral terminals of the power-in receptacle.

16. An electrical interconnect system as set forth in claim 9 wherein two phase electrical power is supplied to said first series of lighting fixtures by said first switching cable assembly, and wherein said first switch for said first switching cable assembly is operable for selectively, independently controlling the first and second phase power circuits in said first series of lighting fixtures, and wherein said lighting fixtures in said first series of lighting fixtures have a first group of lamps having a first ballast connected thereto and a second group of lamps with a second ballast connected thereto, said first ballast being connected to said first power phase and said second ballast being connected to said second power phase such that upon selected operation of said first switch one or both groups of lamps may be selectively energized and de-energized thereby to give multi-level lighting control of said fixtures.

17. Method of interconnecting a plurality of lighting fixtures into one or more series of successive fixtures with the fixtures being energized by means of three phase alternating current electrical power utilizing five lead power cables with each of the series of fixtures being selectively energizable and de-energizable with respect to and independently relative to one another, said method comprising the steps of:

extending a first power cable having a first phase lead, a second phase lead, a third phase lead, and a neutral lead therein from a source of three phase alternating current electrical power;

connecting a first power cable to a first switching cable assembly;

branching a first circuit from said first switching cable assembly for energizing said first series of lighting fixtures at least with said first series of lighting fixtures being energized by a first phase of power using at least said first phase lead and said neutral lead;

connecting a remotely operable first switch to said first switching cable assembly for selectively controlling energization and de-energization of said first series of lighting fixtures;

continuing at least two phase power from said first switching cable assembly to a second switching cable assembly;

cross connecting said leads between said first and second switching cable assemblies such that said second phase lead from said first switching cable assembly becomes the first phase lead to said second switching cable assembly;

branching a second circuit from said second switching cable assembly for energizing a second series of fixtures by a second phase of said three phase electrical power using said second phase lead and said neutral lead from said first switching cable assembly; and connecting a remotely operable second switch to said second switching cable assembly for selectively controlling energization and de-energization of said second series of fixtures.

18. Method of claim 17 further comprising continuaing all three phases of said power from said first switching cable assembly to said second switching cable assembly in the same order as they are received in said first switching cable assembly.

19. Method of claim 18 wherein the method further comprises the steps of continuing said three phase power from said second switching cable assembly to a third switching cable assembly with the leads exiting said second switching cable assembly being in the same order as the leads entering said second switching cable assembly;

cross-connecting said leads between said second and said third switching cable assemblies such that said second phase lead from said second switching cable assembly carrying the third phase of electrical power from said first switching cable assembly becomes the first lead to said third switching cable assembly, so that said first lead to said third switching cable assembly carries the third phase of electrical power;

branching a third circuit from said third switching cable assembly for energizing a third series of fixtures by third phase of electrical power of said three phase electrical alternating current power source using at least said third phase lead and said neutral leads from said first switching cable assembly; and connecting a remotely operable third switch to said third switching cable assembly for selectively controlling energization and de-energization of said third series of fixtures.

* * * * *